US006740388B1

(12) United States Patent
Koket

(10) Patent No.: US 6,740,388 B1
(45) Date of Patent: May 25, 2004

(54) THERMOSET TILE WITH FREEZE-THAW RESISTANT FEATURE

(76) Inventor: George T. Koket, 322 Forest Dr., Erie, PA (US) 16505

( * ) Notice: Subject to any disclaimer, the term of this patent is extended or adjusted under 35 U.S.C. 154(b) by 0 days.

(21) Appl. No.: 10/650,623

(22) Filed: Aug. 28, 2003

Related U.S. Application Data

(62) Division of application No. 10/083,207, filed on Feb. 26, 2002.

(60) Provisional application No. 60/292,004, filed on May 21, 2001, and provisional application No. 60/271,892, filed on Feb. 26, 2001.

(51) Int. Cl.[7] ..... B32B 3/06

(52) U.S. Cl. ..... 428/100; 428/99; 52/309.17; 52/391; 404/34

(58) Field of Search ..... 428/99, 100; 52/309.17, 52/389, 391; 404/34

(56) References Cited

U.S. PATENT DOCUMENTS

| | | | |
|---|---|---|---|
| 2,816,323 | A | 12/1957 | Munger |
| 3,654,018 | A | 4/1972 | Bogue et al. |
| 4,751,799 | A | 6/1988 | Ditcher et al. |
| 5,281,459 | A | 1/1994 | Van Eijck |

*Primary Examiner*—Alexander S. Thomas
(74) *Attorney, Agent, or Firm*—Renner, Otto, Boisselle & Sklar, LLP

(57) ABSTRACT

Tiles molded of thermoset plastic are provided with structure to retain the tiles in their desired position on an exterior surface of a substrate when subjected to repeated freeze-thaw cycles. The tiles are provided with an array of anchors that extend outwardly from the substrate facing surface of the tiles. The anchors have a stretching portion which will allow for some movement imposed by freezing and thawing conditions and will return to its desired position during warmer conditions. The anchors have substrate engaging portions at their distal ends.

16 Claims, 3 Drawing Sheets

THERMOSET TILE WITH FREEZE-THAW RESISTANT FEATURE

CROSS REFERENCE TO RELATED APPLICATIONS

This application claims the benefit of U.S. Provisional Application Serial No. 60/271,892 filed Feb. 26, 2001 and U.S. Provisional Application Serial No. 60/292,004 filed May 21, 2001. This application is a division of U.S. patent application Ser. No. 10/083,207 filed Feb. 26, 2002.

BACKGROUND OF THE INVENTION

The present invention relates generally to a structure molded from thermoset plastic material and having a freeze-thaw resistant feature for exterior use as a tile or wall covering. Tiles are used for outdoor driveways and patios and are typically made of stone, brick or concrete.

BRIEF SUMMARY OF THE INVENTION

Applicant has provided an exterior use tile of thermoset plastic material having a freeze-thaw resistant feature. The thermoset tiles are provided with anchors on the bottom surface, the anchors being suitable to be set into wet concrete to provide a secure supporting surface for foot or vehicle traffic.

In the North, because of the harsher climate, the practice of embedding things in concrete is avoided because water entering any gap or crack when it freezes increases in volume approximately ten percent (10%) and for this reason stones, and other objects such as tiles, will be pushed out of place by the freeze-thaw cycle of the water. Even plastic materials will shrink in the cold and will move out of place.

Applicant's invention provides a mechanical connection between the tile and an underlying substrate, such as concrete. Applicant provides downwardly and outwardly extending members as anchors. These members have an attaching portion that secures the members to the tile, a hook portion that extends outwardly into the underlying substrate to secure the tile in position, and a stretching member portion that extends between the attaching portion and the hook portion. A stretch of one to one and a half percent of the length of the stretch member is desired.

The hook portion or hook member will hold the tile in place because when the water around the tile and hook freezes the supporting portion between the tile and the hook will stretch, allowing the slight but necessary movement of the tile. Upon thaw when the pressure is relieved, the memory of the plastic will return the tile to its original position. The tile can be used indoors or outdoors and can be molded into the side of concrete blocks to decorate outer surfaces.

The hooks which extend outwardly from the bottom surface of the tile may have a connecting or stretching member which extends generally away from the tile and may have a hook element which extends generally parallel to the tile bottom surface. In the alternative, the tile bottom surface may extend generally away from the tile and the hook portion may form an angle with the connecting member greater than 90°. Applicant has found that greater stretch may be obtained in the connecting member when the hook element extends generally parallel to the tile surface.

It is important in this invention that the material used in the tile, in particular, in the connecting member portion of the tile, must have almost exactly the same coefficient of linear expansion with temperature as that of concrete. The outer surface of the thermoset tile can be made to have any desirable design, for example to be made to look like tiles, tile, granite, block or any other surface type treatment and may be decorated with any desired color on its outer surface. The plastic material may be mixed with a colored filler material to match the color on the outer surface. Scratches will be hidden by the colored filler material.

It is an object of the present invention to provide an exterior tile having a freeze-thaw resistant feature suitable for exterior use.

It is another object of the present invention to provide an exterior tile having a freeze-thaw resistant feature suitable for exterior use that is simple in construction, economical to manufacture and simple and efficient to use.

With the above and other objects in view, the present invention consists of the combination and arrangement of parts hereinafter more fully described, illustrated in the accompanying drawing and more particularly pointed out in the appended claims, it being understood that changes may be made in the form, size, proportions and minor details of construction without departing from the spirit or sacrificing any of the advantages of the invention.

BRIEF DESCRIPTION OF THE SEVERAL VIEWS OF THE DRAWING(S)

DETAILED DESCRIPTION OF THE INVENTION

Figure 1:
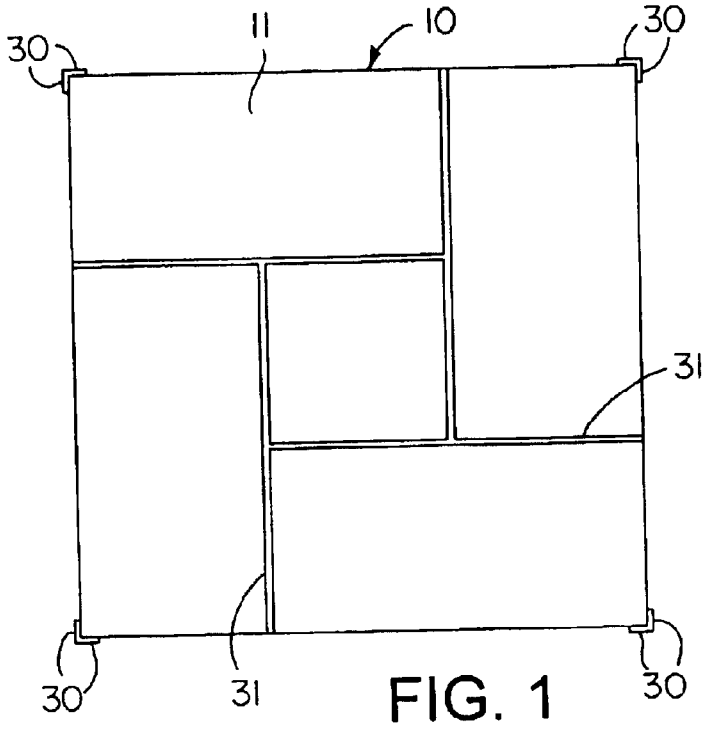
FIG. 1 is a top view of an exterior tile with freeze-thaw resistant feature, according to the invention.
Figure 2:
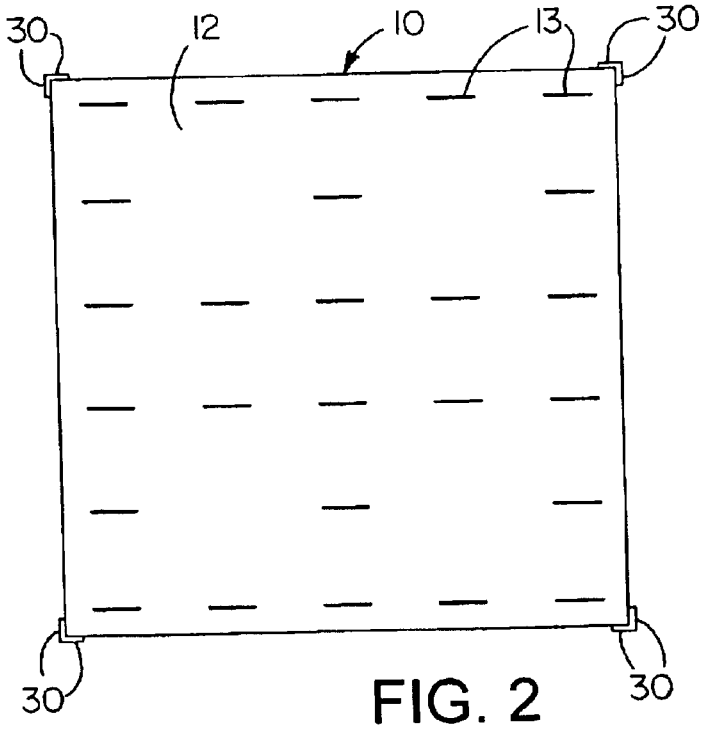
FIG. 2 is a bottom view of an exterior tile showing the freeze-thaw resistant feature according to the invention.
Figure 3:
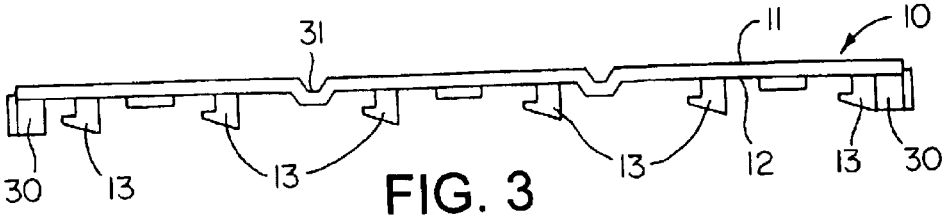
FIG. 3 is a side view of an exterior tile with freeze-thaw resistant feature, according to the invention, showing the hooks protruding from the underside of the tile.

Now with more particular reference to the drawings, shown is an exterior use tile 10 having outer surface 11 and attaching surface 12 made of thermoset plastic material having a freeze-thaw resistant feature which is provided with an array of anchors 13 extending outwardly from attaching surface 12. Anchors 13 are suitable to be set into wet concrete to provide a secure supporting horizontal surface for foot or vehicle traffic, or to provide a durable vertical exterior or interior surface.

In the North, because of the harsher climate, the practice of embedding things in concrete is avoided. Due to the freeze-thaw cycle commonly experienced in the more northern climates water entering any gap or crack will freeze and thaw with the temperature changes. When water freezes it increases in volume approximately ten percent (10%) and for this reason stones, including tiles, will be pushed out of place by the freeze-thaw cycle of the water. Even plastic materials will shrink in the cold and will be moved out of place.

Applicant's invention provides a mechanical connection between tile 10 and underlying substrate 14, such as concrete. The mechanical connection is provided by an array of downwardly and outwardly extending members such as anchors 13 made up of attaching member or attaching portion 15, stretch member 16 and hook member 18. Stretch member 16 is integrally attached at attaching portion 15 to attaching surface 12 of tile 10. Hook member 18 extends outwardly from stretch member 16 to provide engaging surface 20 that will engage underlying substrate 14 which may be made of concrete or other suitable material and resist the pull imposed on tile 10 by the freezing water. When the water around tile 10 and even hook member 18 freezes, stretch member 16, which is the supporting portion between tile 10 and hook member 18, will stretch, allowing the slight but necessary movement of tile 10. Upon thaw when the water melts and the pressure is relieved, the memory of the thermoset plastic will return the tile to its original position. Tile 10 can be used indoors or outdoors and can be molded into the side of concrete blocks to decorate outer surfaces.

Figure 4:
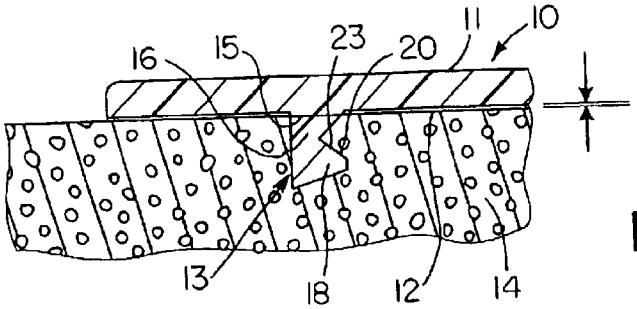
FIG. 4 is an enlarged view of a portion of a tile with the hook descending therefrom, set in concrete, the hook portion extending downwardly and outwardly from the connecting portion according to one embodiment of the invention.
Figure 5:
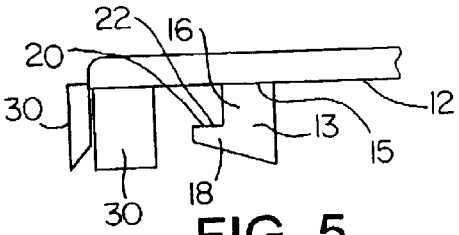
FIG. 5 shows a portion of a tile with a hook member extending downwardly therefrom, the connecting portion having the hook portion forming a 90° angle therebetween.
Figure 6A:
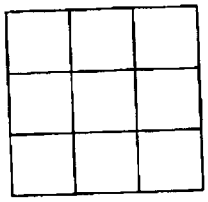
FIGS. 6A through 6I show various patterns of tiles that can be formed from the present invention.
Figure 6B:
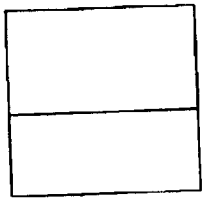
Figure 6C:
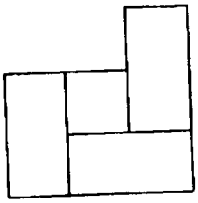
Figure 6D:
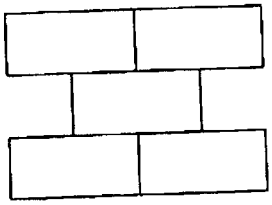
Figure 6E:
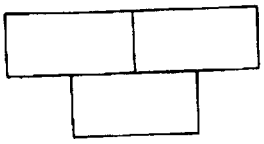
Figure 6F:
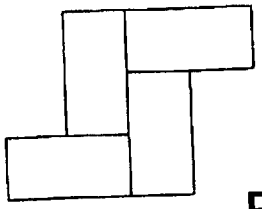
Figure 6G:
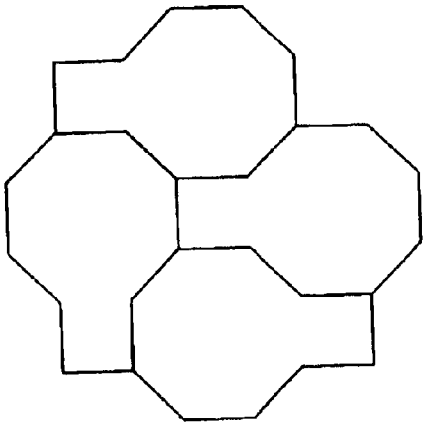
Figure 6I:
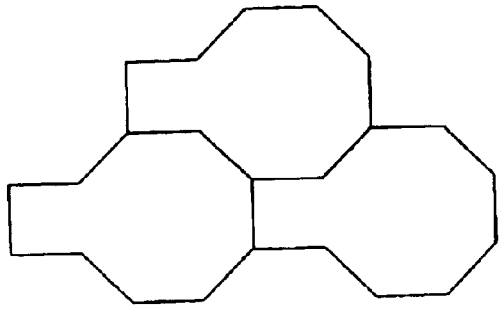
Figure 6H:
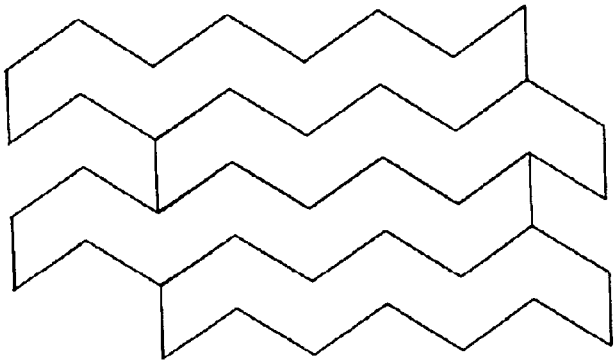

Engaging surfaces 20 may extend generally parallel to attaching surface 12 of tile 10, as shown at 22 in FIG. 5, or may extend outwardly at an angle to attaching surface 12 of tile 10, as shown at 23 of FIG. 4.

Hook members 18, which extend outwardly from attaching surface 12 of tile 10, have connecting member or stretch member 16 which extends generally directly away from tile 10 and has hook member 18 having substrate engaging surface 22 which extends generally parallel to attaching surface 12. In the alternative, connecting member or stretch member 16 may extend generally directly outwardly from tile 10 and terminate in hook member 18 having substrate engaging surface 23 that forms an angle with stretch member 16 greater than 90°. In this embodiment, Applicant has found that greater stretch may be provided by stretch member 16 with the substrate engaging surface generally parallel to attaching surface 12 of tile 10.

It is important in this invention that the material used in tile 10, in particular, in stretch member 16 of tile 10, must have almost exactly the same coefficient of linear expansion with temperature as that of underlying substrate 14, which may be concrete for example. The outer surface of thermoset tile 10 can be made to have any desirable design, for example to be made to look like tiles, tile, granite, block or any other surface type treatment.

The thermoset material used in tile 10 must have little or no chemical affinity for concrete. After tiles 10 have been placed in the concrete substrate and the concrete has been allowed time to set, the excess concrete on the exposed surfaces of tiles 10 can be easily removed and cleaned up to complete the installation of tiles 10.

Spacers 30 may be provided at each side of each of the corners of each tile 10 to accommodate spacing of tiles 10 when laid and to prevent tiles 10 from sliding under one another during installation. Surface texture 31 may be provided in any shape or pattern as contemplated by the invention as described.

The foregoing specification sets forth the invention in its preferred, practical forms but the structure shown is capable of modification within a range of equivalents without departing from the invention which is to be understood is broadly novel as is commensurate with the appended claims.

What is claimed is:

1. A tile adapted for attachment to an exterior surface of a substrate that is subject to freeze-thaw cycles, the tile having an outer surface and an inner surface, an array of anchors extending outwardly from the inner surface, the anchors having stretch portions and hook portions adapted to be set in the substrate, the anchors being made of a thermoset plastic material having a coefficient of linear expansion with temperature that is substantially the same as the substrate, whereby when the tile is placed on the exterior surface of the substrate and the anchors are set in the substrate, the anchors will grow and shrink with changes in temperature at substantially the same rate as the substrate to keep the tile in place on the substrate.

2. The tile of claim 1 wherein the tile is also made of a thermoset plastic material having a coefficient of linear expansion with temperature that is substantially the same as the substrate, whereby when the tile is placed on the exterior surface of the substrate and the anchors are set in the substrate, the tile will grow and shrink with changes in temperature at substantially the same rate as the substrate to keep the tile in place on the substrate.

3. The tile of claim 2 wherein the anchors are integrally attached to the inner surface of the tile.

4. The tile of claim 2 wherein the thermoset plastic material has little or no chemical affinity for the substrate whereby when the tile is placed on the exterior surface of the substrate and the anchors are set in the substrate, any excess substrate on the outer surface of the tile may be easily removed therefrom.

5. The tile of claim 1 wherein the outer surface of the tile is provided with a desired appearance.

6. The tile of claim 1 wherein the hook portions extend outwardly from the stretch portions of the respective anchors generally parallel to the inner surface of the tile.

7. The tile of claim 1 wherein the hook portions extend outwardly from the stretch portions of the respective anchors at an angle greater than 90° from the inner surface of the tile.

8. The tile of claim 1 wherein the array of anchors are all similarly oriented in the same direction relative to the tile.

9. The tile of claim 1 wherein the tile is textured and colored to a desired outer surface appearance.

10. The tile of claim 1 which is made of the same thermoset plastic material as the anchors, the thermoset plastic material of the tile having a colored filler material added to match the color of an outer surface appearance.

11. A tile molded of a thermoset plastic material having an outer surface and an inner surface that is adapted to be secured to an exterior surface of an underlying concrete substrate that is subject to freeze-thaw cycles, the tile having an array of anchors extending outwardly from the inner surface, the anchors having hook portions adapted to engage the substrate and stretch portions extending between the hook portions and the inner surface of the tile, the thermoset plastic material of the tile and anchors having a coefficient of linear expansion with temperature that is substantially the same as the substrate, whereby when the inner surface of the tile is placed on the exterior surface of the substrate and the anchors are set in the substrate, the tile and the anchors will grow and shrink with changes in temperature at substantially the same rate as the substrate to keep the tile in place on the substrate.

12. The tile of claim 11 wherein a plurality of the tiles are adapted to be secured to the exterior surface of the substrate that is exposed to the weather, allowing water to get between the tiles, the stretch portions of the anchors of the respective tiles being stretchable when water gets between the tiles and freezes allowing the tiles to move relative to one another and to the substrate, and when the water between the tiles thaws, the stretch portions have a memory that causes the respective tiles to return to their prior positions on the exterior surface of the substrate.

13. The tile of claim 11 wherein the hook portions extend outwardly from the stretch portions of the respective anchors generally parallel to the inner surface of the tile.

14. The tile of claim 11 wherein the hook portions extend outwardly from the stretch portions of the respective anchors at an angle greater than 90° from the inner surface of the tile.

15. The tile of claim 11 wherein the array of anchors are all similarly oriented relative to the tile.

16. The tile of claim 11 wherein the tile is textured and colored to a desired outer surface appearance.

* * * * *